United States Patent [19]

Kubach et al.

[11] 4,287,794

[45] Sep. 8, 1981

[54] CONTAINER OPENING TOOL

[76] Inventors: John S. Kubach; Elizabeth V. Kubach, both of 1406 Milan Rd., Sandusky, Ohio 44870

[21] Appl. No.: 152,609

[22] Filed: May 23, 1980

[51] Int. Cl.[3] ..... B67B 7/40

[52] U.S. Cl. ..... 81/3.31; 81/3.46 R

[58] Field of Search ..... 81/3.46 R, 3.46 A, 3.34, 81/3.1 R, 3.32, 3.3 R, 3.31

[56] References Cited

U.S. PATENT DOCUMENTS

| | | | |
|---|---|---|---|
| 2,754,582 | 7/1956 | Klok | 81/3.46 R |
| 3,459,075 | 8/1969 | Henderson | 81/3.34 |
| 3,460,411 | 8/1969 | Dyer | 81/3.34 |
| 4,120,216 | 10/1978 | Goldberg | 81/3.46 A |
| 4,133,228 | 1/1979 | De Pooter | 81/3.1 R |

FOREIGN PATENT DOCUMENTS

| | | | |
|---|---|---|---|
| 35202 | 11/1925 | Denmark | 81/3.46 R |

*Primary Examiner*—Roscoe V. Parker

*Attorney, Agent, or Firm*—Shlesinger, Arkwright, Garvey & Dinsmore

[57] ABSTRACT

A tool for opening containers having either tearaway tab and closure panel structures or inwardly pivoting closure panel structures is disclosed, the tool having an elongated body with a hook member at one end, a first projecting member with a generally convex projecting end surface lying on a longitudinal line with the hook member, and a second projecting member having a second generally convex projecting end surface on a longitudinal line with the first convex surface, the two projecting members having a gap therebetween.

15 Claims, 19 Drawing Figures

Fig. 1
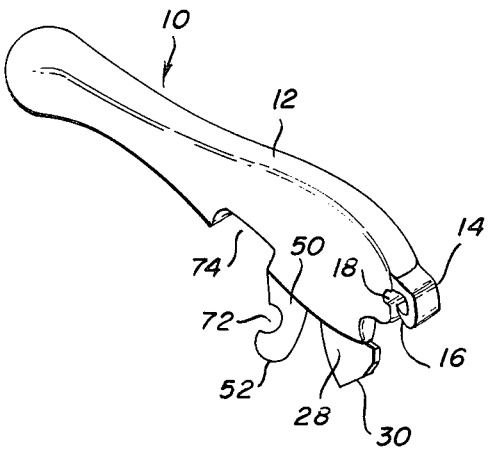
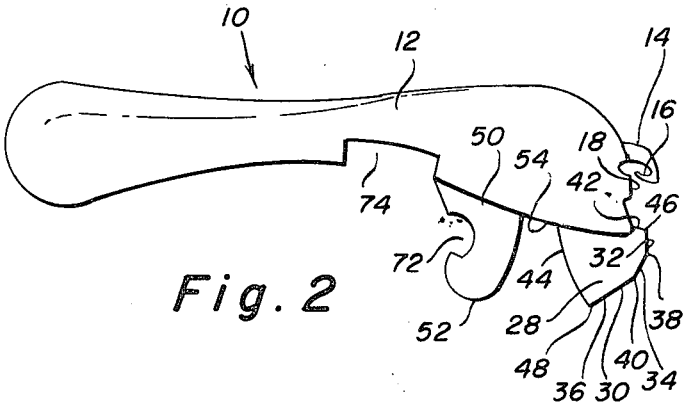
Fig. 2
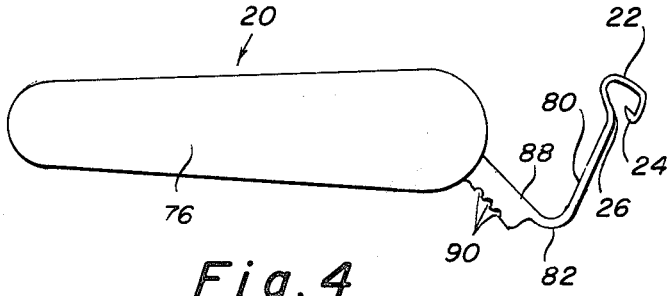
Fig. 4
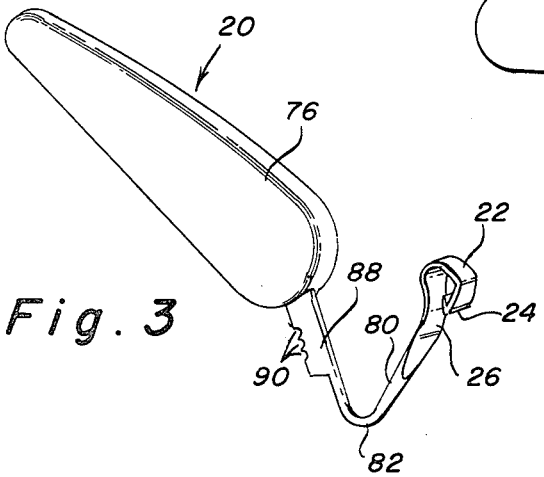
Fig. 3
Fig. 6
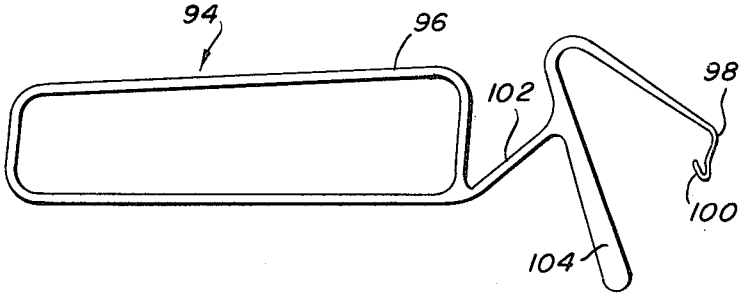
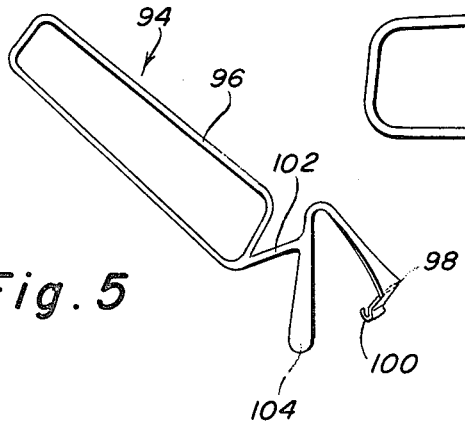
Fig. 5
Fig. 14
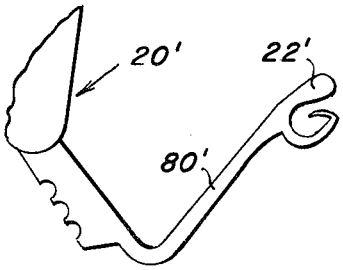

CONTAINER OPENING TOOL

BACKGROUND OF THE INVENTION

This invention relates to container opening tools for containers having frangible closures, popularly known as pop top cans.

In recent years container manufacturers have marketed various metal containers, particularly for beverages, incorporating a frangible closure in one end panel. Such containers are intended to be self-opening to eliminate the necessity of employing a separate opening tool.

Two general types of such containers have come into general use. The first type is that incorporating a tear-away closure panel which is adapted to be removed completely from the container. A ring tab lying flush with the surface of the container is connected to the closure panel by a rivet. To open the container the ring tab is tilted upwardly by inserting a finger under the free end of the tab. This results in the closure-attached end of the tab lifting the end of the closure panel to which it is attached to break the closure panel's seal with the container opening. Next a finger is inserted in the tab opening and the closure panel stripped away from the container opening by pulling the ring tab in a direction upward and away from the top of the container.

The second type has come into use mostly as a result of environmental concerns over the proliferation of used ring tabs with their attached closure panels littering picnic areas, playgrounds and other places where people congregate. This second type also includes a closure panel with a coacting tab which lies flush with the container surface. In this structure, however, the closure panel is adapted to be depressed into the container opening. Neither it nor the tab becomes detached from the container after use. The tab, which is usually rectangular without a central opening, is fastened by a rivet to the container surface adjacent one end of the closure panel with one of its ends overlapping the end of the closure panel to which it is adjacent. To open the container, as with the opening tab of the first type structure, a finger is inserted under the free end of the tab which is pivoted upwardly. As the free end of the tab rises, the end adjacent the closure panel pivots downwardly to abut the closure panel and to pivot it inwardly into the inside of the container to which it remains attached by a hinge formed by a small strip of metal.

While these opening structures were intended to eliminate the need for separate opening tools, these container opening structures have limitations rendering them significantly less useful than originally intended. In gripping the tab, whether of the first or second type, fingernails sometime break or are damaged producing pain and discomfort. The force required to pull the tear-away type closure off and the force required to pivot the tab of the inwardly pivoting closure type results in bruises and cuts in the fingers and thumbs. The two types of tabs occasionally break loose leaving their containers closed or partially opened. To open a container with a broken tab a traditional can opener, pliers, or some suitable gripping tool is required. In addition to the inconvenience this also can lead to cuts on the hands.

Even without breakage under normal circumstances the force required to open either type of container is substantial sometimes resulting in spillage and posing a barrier to use of the containers by those without sufficient strength.

These problems are an inherent and integral part of these type self-opening containers and are more acute among people who daily dispense the contents of such containers such as bartenders, waiters and waitresses, and others involved in serving of refreshments.

SUMMARY OF THE INVENTION

An object of this invention is to provide a container opening tool for use on self-opening containers to aid users in opening such containers.

An object of this invention is to provide a container opening tool for self-opening containers which overcomes the problems outlined above encountered by users when opening these type containers unaided.

An object of this invention is to provide a container opening tool for self-opening closure panel type containers having a hook member for engaging container tabs which captures removable tab and closure panel structures to prevent them from flying away as the container is opened.

An object of this invention is to provide a container opening tool for containers having frangible closure panels which rotates with respect to the container being opened and changes its fulcrum point during its rotation to provide the maximum amount of leverage throughout its rotation.

Another object of this invention is to provide a container opening tool for containers having an inwardly pivoting closure panel.

A further object of this invention is to provide a container opening tool which is adapted for use with containers having frangible closure panels and tabs of both common types, i.e. the tear-away closure panel and tab type and the inwardly pivoting closure panel type.

Another object of this invention is to provide a container opening tool for use on self-opening containers which may be hand holdable or adapted to be used in a mounted fixture.

The invention is an opening tool for a container having a frangible closure with an opening tab comprising: an elongated body member; a hook means at one end of the body member for engaging the lifting end of an opening tab, the hook means comprising an elongated element folded inwardly on itself and terminating in an inwardly projecting tip member disposed at an acute angle with respect to the portion of the element at the base of the tip member; and, abutment means projecting from the body member fixed in spaced relation with respect to the hook means at a predetermined distance from the hook means for abutting the closure panel of the container when the hook means engages the lifting end of the opening tab, whereby the tool is rotatable with respect to the container to open the closure.

The abutment means may comprise a rod shaped arm having two generally straight portions oriented at an angle with respect to one another so as to provide a downwardly projecting elbow for abutting the closure panel of a container.

Alternatively, the abutment means may comprise a generally rod shaped projecting member projecting downwardly from the forward end of a forward extension of the body member, the forward extension being a generally straight rod shaped member disposed at an angle with respect to the longitudinal axis of the tool and inclined upwardly proceeding from the rear of the extension forward toward the hook means, the forward extension lying in a plane with the hook means and the projecting member.

In another embodiment the container opening tool comprises: an elongated body member with a front end and a rear end; a hook member at the front end of the body member for engaging the lifting end of a container opening tab; a first projecting member extending from the body member adjacent the hook member, the first projecting member having a first generally convex projecting end surface on a longitudinal line with the hook member, the convex surface having a forward segment closer to the hook member and a rear segment farther removed from the hook member, the forward segment being spaced from the hook member so as to abut the inner end of the opening tab, the tab when engaged by the hook member and abutted by the forward segment defining a imaginary plane, the first convex surface being increasingly spaced from the plane progressing from the forward segment towards the rear segment; and, a second projecting member extending from the body member and spaced rearwardly from the first projecting member, the second projecting member having a second generally convex projecting end surface on a longitudinal line with the first convex surface, the first and second projecting members having a recess or gap therebetween.

In this embodiment the tool may include a mounted fixture for the tool in which case the tool will also include two hinge pins situated on a common axis and projecting from each side of the tool in a direction perpendicular to the longitudinal axis of the tool. The mounted fixture comprises channel means adapted to cooperate in sliding engagement with the hinge pins for guiding the tool in translational and rotational motion while the tool is opening a container and container support means fixed in position relative to the channel means for holding the container in position relative to the channel means while the container is being opened with the tool.

BRIEF DESCRIPTION OF THE DRAWINGS

FIG. 1 is a perspective view of a container opening tool according to the invention;

FIG. 2 is a side elevational view of the tool of FIG. 1;

FIG. 3 is a perspective view of an alternate embodiment of a container opening tool according to the invention;

FIG. 4 is a side elevational view of the tool of FIG. 3;

FIG. 5 is a perspective view of another alternative embodiment of a container opening tool according to the invention;

FIG. 6 is a side elevational view of the tool of FIG. 5;

FIG. 14 is a fragmentary side elevational view showing a modified form of the embodiment of FIGS. 3 and 4 having a modified hook structure;

DETAILED DESCRIPTION OF THE PREFERRED EMBODIMENTS

Figure 7:
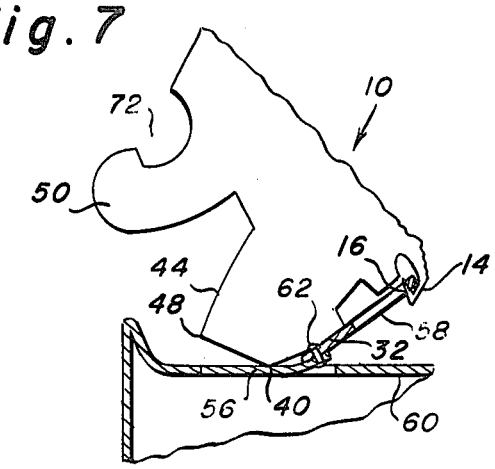
FIGS. 7–9 are fragmentary schematic views showing the container opening tool of FIGS. 1 and 2 in successive stages of operation opening a container having a tear-away tab and closure panel.

Referring to FIGS. 1 and 2 a container opening tool 10 is shown having an elongated body 12 made in the form of a handle to be gripped by a user. At the front end of the body 12 is a hook 14 comprising an elongated element curved or folded downwardly and inwardly on itself and terminating in an inwardly projecting generally straight tip member 16 which is disposed at an acute angle with respect to the portion of the hook element 14 at the base of the tip member 16. Opposite to the tip member 16 is an opposing member 18 which is spaced from the tip member 16 so as to form a narrow downwardly facing gap between the tip member 16 and the opposing member 18.

Alternatively, as shown in the modified embodiment 20 of FIGS. 3 and 4, the hook 22 may be so curved that an additional opposing member 18 is not necessary. In the tool 20 the hook 22 is so curved and oriented that the tip member 24 is opposed to and adjacent the base 26 of the hook 22 thus in that manner defining a narrow downwardly facing gap.

Extending downwardly from the body 12 immediately behind and adjacent to the hook 14 is a first projecting member or plate 28 having a generally convex downwardly projecting end surface 30 which extends longitudinally on a longitudinal line with the hook 14, the longitudinal line and the plate 28 being in the same plane as the longitudinal axis of the tool 10.

The end surface 30 is comprised of three flat segments, forward segment 32 closest to hook 14, intermediate segment 34, and rearward segment 36 farthest removed from the hook 14. The three segments 32, 34, 36 thereby form two projecting points 38, 40 between respective pairs of the segments 32, 34, 36. The projecting plate 28 also has anterior and posterior surfaces 42, 44 with the posterior surface 44 in particular being oriented generally transversely to the longitudinal axis of the tool 10. The anterior surface 42 joins the forward end 46 of the end surface 30 at an angle substantially perpendicular with respect to the forward end 46. Similarly, the posterior surface 44, which is generally convex, joins the rearward end 48 of the end surface 30 at an angle substantially perpendicular with respect to the rearward end 48 of the end surface 30, i.e. that portion of the posterior surface 44 immediately adjoining the rearward end 48 of the end surface 30 and the rear segment 36 are substantially perpendicular with respect to one another. Projecting points are thus also formed at the forward end 46 of the projecting surface 30 and at the rearward end 48.

Also extending downwardly from the body 12 to the rear of the plate 28 and spaced therefrom is a second projecting member or plate 50 having a second generally convex downwardly projecting end surface 52 which extends longitudinally on a longitudinal line with the first projecting end surface 30, the plate 50 lying in the same plane as the longitudinal axis of the tool 10 and the first plate 28. The second end surface 52 is more arcuate than the first end surface 30 having curved forward and rear shoulders and no projections as does the first end surface 30.

A gap is located between the projecting plates 28 and 50 terminating in a flat upper surface 54.

The structural elements of the tool 10 are disposed at predetermined distances from one another in preset relationships so that, when in use, the various elements of tool 10 will make contact with certain parts of the closure panel and tab of a container structure permitting various functions to be performed by the respective elements of the tool 10 in opening the container.

Figure 8:
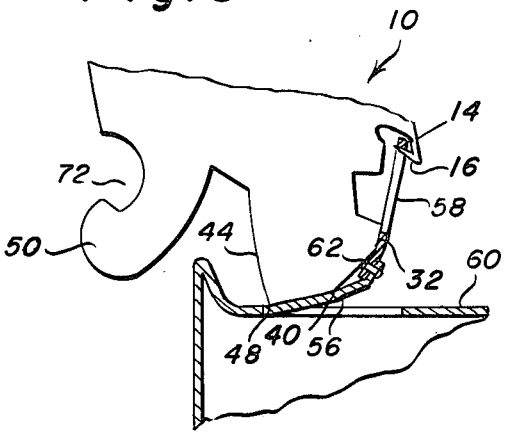
Figure 9:
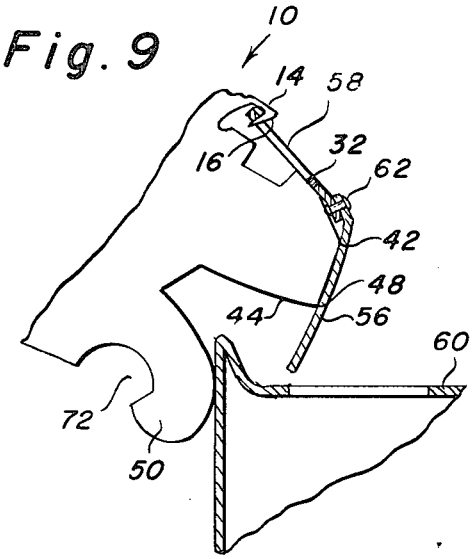

Referring to FIGS. 7–9, the use of the tool 10 in removing the closure panel 56 and tab 58 from a container 60 having a tear-away closure panel and tab is shown. Initially, the tool 10 is engaged with the tab 58 which is lying flush with the container surface. Generally, the tab 58 of a tear-away closure has an annular structure and the hook 14 is engaged about the annulus at the lifting or free end of the tab 58 with the tip element 16 projecting through the opening in the annulus. The first segment 32 of the projecting surface 30 abuts the closure-attached end of the tab 58 adjacent the rivet 62 which connects the tab 58 with the closure panel 56. The first segment 32 generally lies flat on the surface of the tab 58.

The tab 58 when so engaged defines an imaginary plane in which the interior of the hook 14 and the first segment 32 lie. This imaginary plane is perpendicular to the plane of projecting plates 28 and 50. The successive segments 34, 36 of the first convex surface 30 are increasingly spaced from this imaginary plane progressing from the forward segment 32 toward the rear segment 36. While other angular interrelationships are possible between the imaginary plane defined by the hook 14 and first segment 32 and the planes in which the intermediate and rear segments 34, 36 lie, the following ranges have been found to be optimal. (All planes referred to are perpendicular to the plane of projecting plates 28 and 50). Between the planes defined by the forward segment 32 and the intermediate segment 34 an angle of between 15° and 30° is optimal although an angle between 5° and 45° may be used. Between the plane of the forward segment 32 and the plane of the rear segment 36 an angle of between 50° and 65° is optimal although this angle may be between 40° and 80°. Also, the flat surface 54 of the top of the gap between the first projecting member 28 and the second projecting member 50 lies in a plane which intersects the plane of the first segment 32. The angle between these two planes is optimally 100° to 110° but may be between 90° and 120 °.

With the hook 14 and the first segment 32 of the projecting surface 30 engaged on the tab 58, the tool 10 is rotated in the direction of the closure 56. The tab 58 is lifted from its free end with the tab 58 and the tool 10 pivoting about the area of the rivet 62 and the first segment 32. This results in the breaking of the seal formed by the closure panel 56 at the end of the closure panel 56 at the rivet 62. As the rotation of the tool 10 continues, the projection 40 of the end surface 30 is brought into contact with the closure panel 56 to abut the closure panel 56 generally in its center. This becomes a new fulcrum point for the rotation of the tool 10 which, as the rotation continues, progressively peels the closure panel 56 from the container 60 beginning from the end of the closure panel 56 at the rivet 62 and progressing outwardly toward the perimeter of the container 60. Projection 48 functions similarly, abutting the closure panel 56 adjacent the edge of the closure panel adjacent the container perimeter to become yet another fulcrum point.

As the rotation of the tool 10 progresses about the fulcrum point of the projection 48, the second projecting member 50 comes into abutting relationship with the container surface as shown in FIG. 9. The new fulcrum point provided by the projecting member 50 results in the further rotation of the tool 10 pivoting the first projecting member 28 away from the surface of the container 60 thus snapping the closure panel 56 from its final point of connection with the container 60 at the end of the closure panel 56 adjacent the container perimeter. The force applied to the tab 58 and the closure panel 56 could result in the tab and closure panel flying away as they become free of the container 60 but the unique structure of the hook 14 which has only the narrow access gap and thereby almost completely encompasses the outer portion of the annulus of the tab 58 results in the capture of the tab and closure panel as they become free of the container 60.

Figure 10:
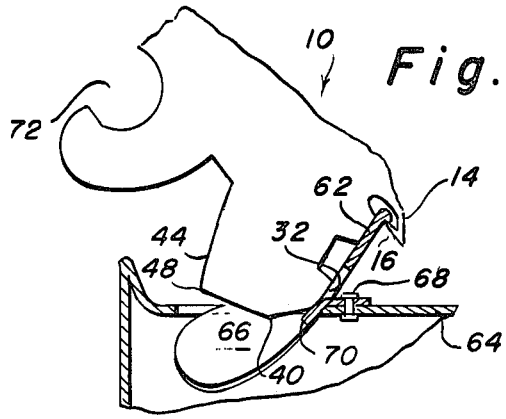
FIGS. 10 and 11 are fragmentary schematic views showing the container opening tool of FIGS. 1 and 2 in successive stages of operation opening a container having an inwardly pivoting closure panel.
Figure 11:
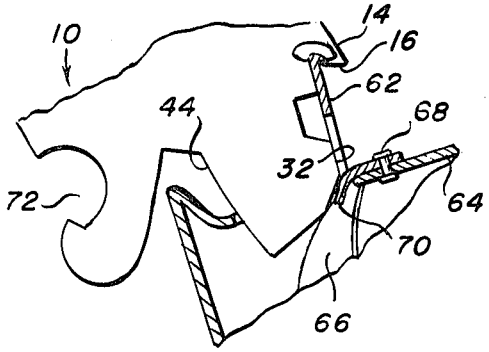

In addition to being adapted for use on tear-away type closures the tool 10 may also be used to open containers having inwardly pivoting closure panels as shown in FIGS. 10 and 11. Here the hook 14 and first segment 32 of the surface 30 engage the lifting and closure-adjacent ends of the tab 62 respectively although the tip element 16 does not pass through an opening in the tab 62 which, unlike the tab 58 of the tear-away type closure, does not have an annular construction usually. This poses no problem because the tab 62 of the inwardly pivoting structure remains with the container 64. Thus there is no need to protect against its flying away.

As the tool 10 is rotated in the direction of the closure panel 66, the tab 62 is lifted by its lifting end with the tab 62 and the tool 10 pivoting about the area of the rivet 68 where the tab 62 is fastened to the container 64. This results in the closure-adjacent edge 70 of the tab 62 pivoting downwardly with the added assistance of the first segment 32 of the projecting surface 30 abutting it. The tab edge 70 engages the closure panel 66 and forces it into the container 64. Simultaneously, the rear segment 36, or some part thereof such as the projection 48 or the projection 40, of the surface 30 comes into abutting engagement with the closure panel 66 thus assisting the tab 62 in forcing the closure panel 66 into the interior of the container 64. The projecting member 28 is so dimensioned that its posterior transverse surface 44 passes just to the inside of the edge of the container opening adjacent the container perimeter thus permitting the projecting member 28 to enter the container opening. Also permitting the projecting member 28 to aid in forcing the closure panel 66 into the container 64 is the gap situated between the first projecting member 28 and the second projecting member 50 which is dimensioned and positioned so as to receive the lip of the container adjacent the container opening. The upper surface 54 of the gap is slightly longer than the distance between the container perimeter and the edge of the container opening adjacent the perimeter and acts as a stop to engage the lip of the container when the rotation of the tool 10 is complete.

It can thus be seen that the structural elements of the tool 10 are fixed in position relative to one another and oriented at predetermined distances from one another so as to be able to coact with elements of the container structure in various ways. In one example of tool 10, the distance from the end of the tip element 16 of the hook 14 to the forward projection 46 on the first projecting member 28 is 9/16 inches, from the end of the tip element 16 to the rear projection 48 of the first projecting member 28 is 1-5/16 inches, from the tip element 16 to the rearward end of gap surface 54 is $1\frac{1}{8}$ inches and from the tip element 16 to the bottom of the second projecting member 50 is 2 inches. The three segments of the projecting surface 30 of the projecting member 28 are from front to rear optimally $\frac{1}{8}$ to $\frac{1}{2}$ inches in length, $\frac{1}{8}$ to $\frac{1}{2}$ inches in length, and $\frac{1}{8}$ to $\frac{5}{8}$ inches in length, respectively. The flat top surface 54 of the gap between the projecting members 28, 50 is optimally $\frac{1}{2}$ inches to $\frac{3}{4}$ inches in length.

The rear 72 of the second projecting member 50 is adapted to serve as a bottle cap opener. Additionally the bottom 74 of the handle portion of the body 12 has an appropriately dimensioned recess for use in removing twist off caps.

Figure 12:
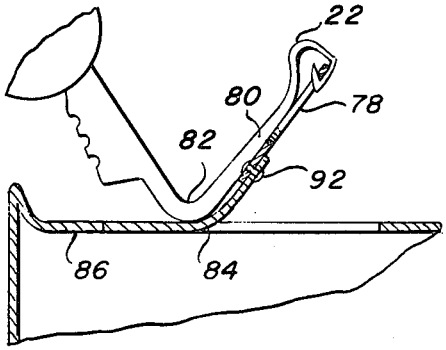
FIGS. 12 and 13 are fragmentary schematic views showing the container opening tool of FIGS. 3 and 4 in successive stages of operation opening a container having a tear-away tab and closure panel.
Figure 13:
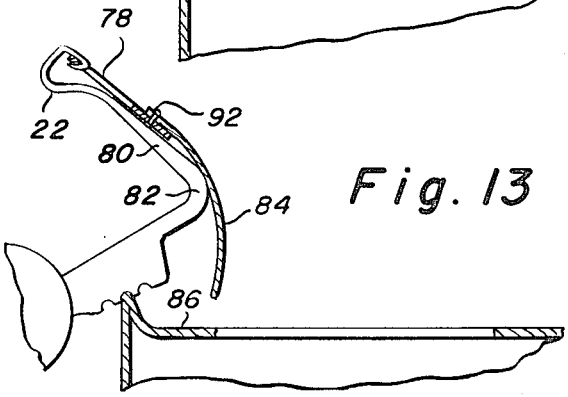

Referring to FIGS. 3 and 4 an alternative embodiment 20 of the invention is shown in which an elongated body member 76 adapted to serve as a handle has at one end thereof a hook member 22 for engaging the lifting end of a container tab 78 as shown in FIGS. 12 and 13. The hook 22 is positioned on the end of a rod shaped arm 80 which has two generally straight portions oriented at an acute angle with respect to one another so as to provide a downwardly projecting elbow 82 for abutting the closure panel 84 of a container 86. The arm 80 lies in the same plane as the hook 22 and the longitudinal axis of the tool 20.

Positioned on the tool 20 on the one straight portion of arm 80 removed from the hook 22 is a rack 88 having a plurality of reccesses 90 disposed in the longitudinally extending plane in which lie the hook 22 and the elbow 82 in fixed relation with respect to the hook 22 and the elbow 82. The recesses 90 serve to engage the lip of the container 86 to provide an additional fulcrum point when the container 86 is opened.

The tool 20 is only usable with tear-away type closures. Referring to FIGS. 12 and 13, the tool 20 is positioned with the hook 22 engaging the lifting end of a tear-away tab 78 and the arm 80 resting against the rivet area 92 at which the tab 78 is connected to the closure panel 84. As the tool 20 is rotated towards the closure panel 84 first the tab 78 and then the closure panel 84 are lifted upward with the closure panel being progressively peeled from the container 86. As the tool 20 rotates, its fulcrum point progressively moves along the elbow 82 which abuts the closure 84. Rotation continues as, depending on the size of the container 84, one of the recesses 90 engages the lip of the container 84 thus shifting the fulcrum point from the elbow 82 to that one of the recesses 90. Continued rotation now snaps the closure panel 84 from its final connection with the container 86 at the end of the container opening adjacent the container perimeter.

In FIG. 14 a tool 20' is shown similar to tool 20 but having a modified hook member 22' which is adapted to engage the lifting end of an annular tab by the arm 80' being inserted into the opening in the tab annulus.

Figure 15:
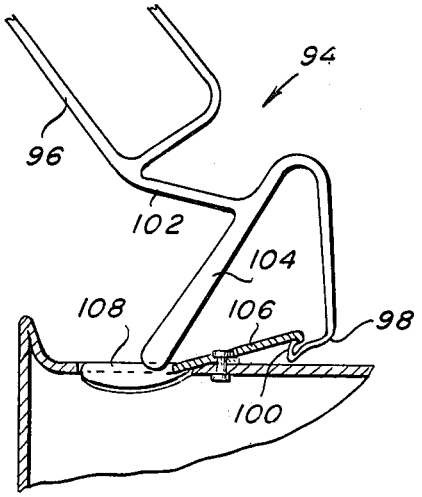
FIGS. 15 and 16 are fragmentary schematic views showing the container opening tool of FIGS. 5 and 6 in successive stages of operation opening a container having an inwardly pivoting closure panel.
Figure 16:
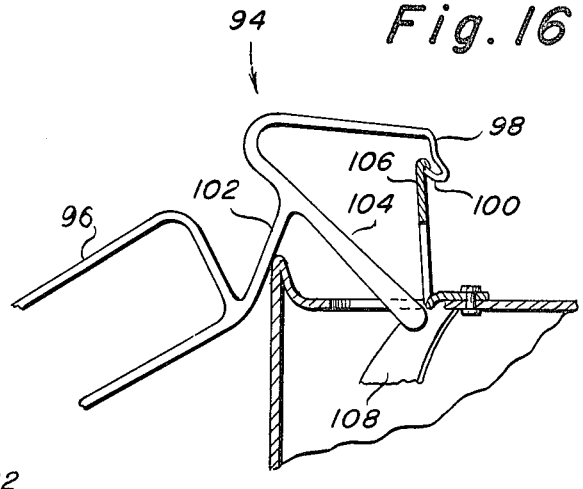

Referring to FIGS. 5 and 6 another tool 94 according to the invention is shown adapted for use only with containers having inwardly pivoting closure panels. The tool 94 has an elongated body member 96 adapted to be used as a handle and positioned at the front end thereof is a hook member 98 comprising an elongated element folded downwardly and inwardly on itself and terminating in an inwardly projecting generally straight tip member 100 which is disposed at an acute angle with respect to the portion of the hook member 98 at the base of the tip member 100. The tip member 100 functions in a manner similar to the hooks of the other embodiments described. Since tool 94 is for use only with containers having inwardly pivoting closure panels, the hook member 98 does not have an opposing member forming a narrow gap with the hook member 98. The body member 96 includes a generally straight rod shaped forward extension 102 disposed at an angle with respect to the longitudinal axis of the tool 94 so as to be inclined upwardly proceeding from the back toward the front of the tool 94. Projecting downwardly from the forward end of the extension 102 of the body member 96 is a generally rod shaped projecting member 104 with a rounded base fixed in spaced relation with respect to the hook member 98 at a predetermined distance from the hook member 98 set so that the projecting member 104 will abut the closure panel of a container having an inwardly pivoting closure panel when the hook member 98 engages the lifting end of the closure panel's tab. The projecting member 104, hook member 98, and foward body extension 102 lie in the same plane which coincides with the longitudinal axis of the tool 94. The body extension 102 and projecting member 104 form between one another a recess in the longitudinally extending plane at predetermined distances from the hook member 98 and the projecting member 104 so as to receive that portion of the container between the container perimeter and the edge of the container opening adjacent the perimeter as the tool 94 is rotated with respect to the container. The projecting member 104 can thereby enter the container opening to remain in abutting contact with the inwardly pivoting container closure panel. Extending from the top of the projecting member 104 is the hook member 98. FIGS. 15 and 16 show tool 94 in successive stages of operation. The hook member 98 is used to engage the lifting end of a tab 106 while the tool 94 is so positioned that the projecting member 104 abuts the closure panel 108 generally in the center thereof. By pulling outwardly and simultaneously pivoting or rotating downwardly on the tool 94, the hook member 98 will pivot the tab 106 upwardly while the projecting member 104 will aid the tab 106 in forcing the closure panel 108 inwardly into the container being opened.

Figure 17:
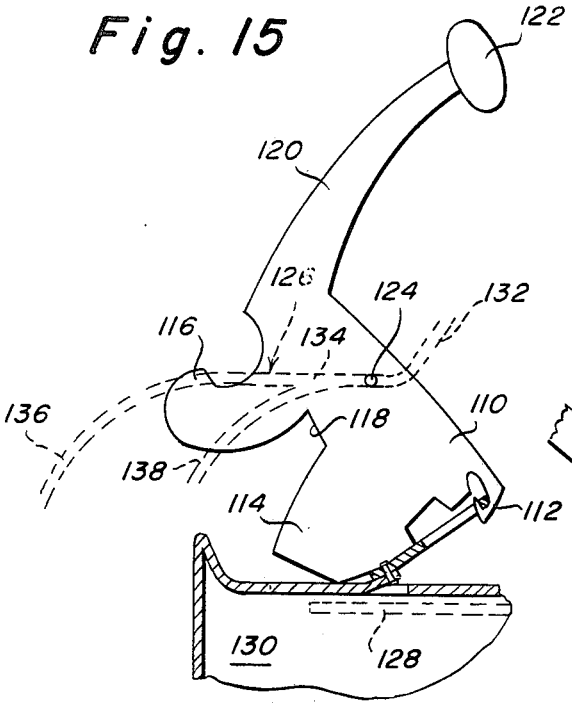
FIGS. 17 and 18 are schematic views showing an alternative embodiment of a container opening tool according to the invention in successive stages of operation opening a container having a tear-away tab and closure panel; and, FIG. 19 is a schematic view similar to FIGS. 17 and 18 showing the container opening tool in operation opening a container having an inwardly pivoting closure panel.
Figure 18:
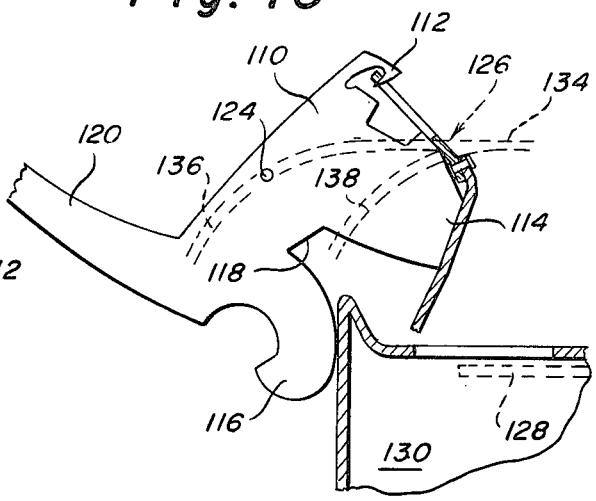
Figure 19:
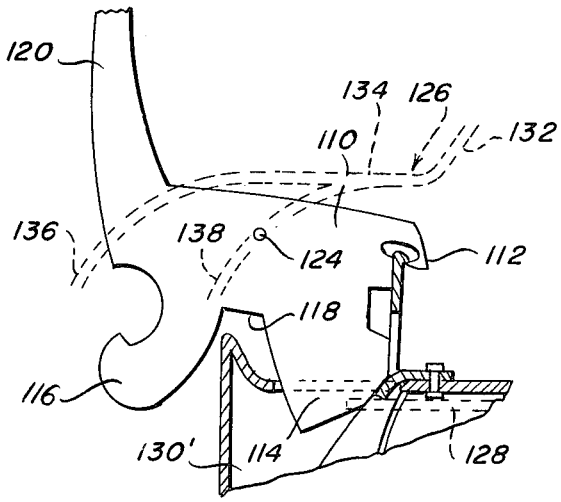

Referring now to FIGS. 17–19, a modification of the tool 10 is shown in which the tool is adapted for use in a mounted fixture positioned, for example, on a wall or under a bar. The modified tool 110 has a hook structure 112, first projecting member 114, second projecting member 116, the gap 118, which are the same in structure and in function as the corresponding elements of the tool 10.

The elongated body of the tool 110, however, has a rear portion 120 curved upwardly from a point behind the second projecting member 116 and ends in a ball 122. Positioned in the body of the tool 110 are two hinge pins 124 situated on a common axis each of which projects from one side of the tool 110 in a direction perpendicular to the longitudinal axis of the tool 110 and the plane in which lie the projecting members 114 and 116.

The pins 124 are adapted to slidably engage a pair of fixedly mounted guide channels 126 each of which is disposed on one side of the tool 110 and by means of which in cooperation with the hinge pins 124 the tool 110 may be engaged in rotational and translational motion. Mounted in a fixed position relative to the guide channels 126 are a pair of spaced support members 128 for receiving and holding in position relative to the guide channels 126 a container 130 to be opened by the tool 110. The container 130 is supported by the bead which is located about the perimeter of the container where the container end panel is joined to the body of the container.

The guide channels 126 each have four corresponding portions, a first inclined curved portion 132, a generally straight horizontal portion 134, a second inclined curved portion 136, and a third inclined curved portion 138. These channel portions 132, 134, 136 and 138 serve to guide the translational motion of the tool 110 in predetermined ways as it is rotated with respect to the container 130 in opening the container 130. Portion 132 functions to guide the tool 110 into initial engagement with the tab and closure panel of the container 130. Portion 134 serves to position the tool 110 in abutting engagement with the container 130 as the tool 110 progressively removes a tab and closure panel of the tear-away type. The second inclined curved portion 136 comes into play as the fulcrum point shifts from the first projecting member 114 to the second projecting member 116 and the tear-away tab and closure panel are detached from the container 130.

The mounted unit may also be used to open a container having an inwardly pivoting closure panel as shown in FIG. 19. In this operation the tool 110 will be constrained by the structure of the container 130' to follow the third inclined curved portion 138.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

We claim:

1. A container opening tool for a container having a frangible closure panel with an opening tab, comprising:

an elongated body member;

hook means at one end of said body member for engaging the lifting end of the opening tab of the frangible closure panel, said hook means comprising an elongated element folded inwardly on itself and terminating in an inwardly projecting tip member disposed at an acute angle with respect to the portion of said element at the base of said tip member;

first abutment means for abutting the frangible closure panel of the container and the inner end of the opening tab when said hook means engages the lifting end of the opening tab, said first abutment means projecting from said body member and fixed in spaced relation with respect to said hook means at a predetermined distance from said hook means;

second abutment means for abutting the surface of the container in opening a container having a tear-away closure panel and for thereby moving said first abutment means away from the container, said second abutment means being spaced rearwardly from said first abutment means; and, means for receiving the lip of the container adjacent the container opening in opening a container having an inwardly pivoting closure panel.

2. The container opening tool of claim 1 wherein said tip member is opposed to and adjacent the base of said hook means thus defining a narrow gap between said tip member and said base.

3. The container opening tool of claim 1 wherein said hook means includes an opposing member opposite to and spaced from said tip member thus defining a narrow gap between said tip member and said base.

4. The container opening tool of claim 1 and including a mounted fixture for said tool, said tool including two hinge pins situated on a common axis and projecting from each side of said tool in a direction perpendicular to the longitudinal axis of said tool, said mounted fixture comprising:

channel means adapted to cooperate in sliding engagement with said hinge pins for guiding said tool in translational and rotational motion while said tool is opening a container; and, container support means fixed in position relative to said channel means for holding said container in position relative to said channel means while said container is being opened with said tool.

5. The container opening tool of claim 4 wherein said channel means includes:

a first portion for bringing said tool in to initial engagement with said container;

a second portion for positioning said tool in abutting engagement with said container as said tool progressively removes a tear-away tab and closure panel;

a third portion for guiding said tool as said second abutment means is brought into engagement with said container to detach said tear-away tab and closure panel from said container; and, a fourth portion for guiding said tool in opening said container when having an inwardly pivoting closure panel.

6. The container opening tool of claim 4 wherein said rear end of said body member curves upwardly.

7. A container opening tool for a container having a frangible closure panel with an opening tab, comprising:

an elongated body member having a front end and a rear end;

hook means at said front end of said body member for engaging the lifting end of the opening tab of the frangible closure panel;

first abutment means for abutting the frangible closure panel of the container and the inner end of the opening tab when said hook means engages the lifting end of the opening tab, said first abutment means comprising a first projecting member extending from said body member adjacent said hook means fixed in spaced relation with respect to said hook means at a predetermined distance from said hook means, said first projecting member having a first generally convex projecting end surface extending longitudinally on a longitudinal line with said hook means, said convex surface having a forward segment closer to said hook means and a rear segment farther removed from said hook means, said forward segment being spaced from said hook means so as to abut the inner end of the opening tab, the tab when engaged by said hook means and abutted by said forward segment defining an imaginary plane, said first convex surface being increasingly spaced from said plane progressing from said forward segment toward said rear segment;

second abutment means for abutting the surface of the container in opening a container having a tear-away closure panel and for thereby moving said first abutment means away from the container, said second abutment means comprising a second projecting member extending from said body member and spaced rearwardly from said first projecting member, said second projecting member having a second generally convex projecting end surface extending longitudinally on a longitudinal line with said first convex surface; and, means for receiving the lip of the container adjacent the container opening in opening a container having an inwardly pivoting closure panel, said lip receiving means comprising a gap between said first and second projecting members.

8. The container opening tool of claim 7 wherein said first projecting member has a transverse posterior surface extending from said body member to the rearward end of said rear segment, said posterior surface immediately adjoining the rearward end of said rear segment and said rearward end of said rear segment being substantially perpendicular with respect to one another.

9. The container opening tool of claim 8 wherein said transverse posterior surface is generally convex.

10. The container opening tool of claim 7 wherein said hook means comprises an elongated element curved inwardly on itself and terminating in an inwardly projecting straight tip member disposed at an acute angle with respect to the portion of said element at the base of said tip member.

11. The container opening tool of claim 7 wherein said tip member is opposed to and adjacent the base of said hook means thus defining a narrow gap between said tip member and said base.

12. The container opening tool of claim 7 wherein said hook means includes an opposing member opposite to and spaced from said tip member thus defining a narrow gap between said tip member and said opposing member.

13. A container opening tool for a container having a frangible closure panel with an opening tab, comprising:

an elongated body member with a front end and a rear end;

a hook member at said front end of said body member for engaging the lifting end of said tab;

a first projecting member extending from said body member adjacent said hook member, said first projecting member having a first generally convex projecting end surface on a longitudinal line with said hook member, said first convex surface having a forward segment closer to said hook member, a rear segment farther removed from said hook member, and an intermediate segment between said forward and rear segments, each of said segments being a flat surface, said segments thereby forming two projecting points between respective pairs of said segments, said first convex surface also including a projecting point at the forward end of said forward segment and a projecting point at the rearward end of said rearward segment;

said forward segment being spaced from said hook member so as to abut the inner end of said opening tab, said tab when engaged by said hook member and abutted by said forward segment defining an imaginary plane, said first convex surface being increasingly spaced from said plane progressing from said forward segment toward said rear segment; and, a second projecting member extending from said body member and spaced rearwardly from said first projecting member, said second projecting member having a second generally convex projecting end surface on a longitudinal line with said first convex surface, said first and second projecting members having a gap therebetween.

14. The container opening tool of claim 13 wherein said projecting point of said first convex surface between said intermediate segment and said rear segment is spaced at a predetermined distance from said hook member whereby, when said tool is in use and being rotated with respect to said container, said projecting point between said intermediate segment and said rear segment will abut the closure panel of said container generally in the center of said closure panel.

15. The container opening tool of claim 13 wherein the rearward end of said rear segment is spaced a predetermined distance from said hook member whereby, when said tool is in use and being rotated with respect to a container, the rearward end of said rear segment will abut the closure panel of said container generally adjacent the outside end of said closure panel.

* * * * *